US007441736B2

(12) United States Patent
Wiltfang

(10) Patent No.: US 7,441,736 B2
(45) Date of Patent: Oct. 28, 2008

(54) BRACKET FOR RETAIL STORE DISPLAY SYSTEMS

(75) Inventor: Rohland Wiltfang, West St. Paul, MN (US)

(73) Assignee: Target Brands, Inc., Minneapolis, MN (US)

( * ) Notice: Subject to any disclaimer, the term of this patent is extended or adjusted under 35 U.S.C. 154(b) by 275 days.

(21) Appl. No.: 10/957,912

(22) Filed: Oct. 4, 2004

(65) Prior Publication Data

US 2006/0071133 A1 Apr. 6, 2006

(51) Int. Cl.
*A47B 96/06* (2006.01)
*A47F 5/08* (2006.01)

(52) U.S. Cl. ..... 248/220.42; 211/87.1; 248/220.31; 248/220.41

(58) Field of Classification Search ..... 248/122.11, 248/220.42, 309.1, 220.43, 220.41, 220.31, 248/221.11, 209.1, 222.11; 211/7, 59.1, 211/87.01, 57.1, 104, 106, 54.1, 87.1
See application file for complete search history.

(56) References Cited

U.S. PATENT DOCUMENTS

| | | | | |
|---|---|---|---|---|
| 4,258,892 | A | 3/1981 | Craine | |
| 4,516,681 | A * | 5/1985 | Jahel | 211/59.1 |
| 4,632,256 | A | 12/1986 | Gambello | |
| 4,898,354 | A | 2/1990 | Whittington et al. | |
| 5,109,992 | A * | 5/1992 | Miller | 211/59.1 |
| 5,372,382 | A * | 12/1994 | Whitens | 280/808 |
| 5,411,237 | A * | 5/1995 | Dougherty | 248/534 |
| 5,423,436 | A | 6/1995 | Morrow | |
| 5,673,887 | A * | 10/1997 | Hollingsworth et al. | 248/220.31 |
| 5,813,579 | A * | 9/1998 | Hendrickson | 224/42.11 |
| 6,003,685 | A * | 12/1999 | Malin | 211/7 |
| 6,015,124 | A * | 1/2000 | Loy | 248/220.31 |
| D442,076 | S | 5/2001 | Swanson | |
| 6,349,909 | B1 | 2/2002 | Zarrow et al. | |
| 6,431,374 | B1 | 8/2002 | Winikoff | |
| D467,792 | S | 12/2002 | Zadak et al. | |
| 6,502,706 | B1 | 1/2003 | Kent | |
| D470,397 | S * | 2/2003 | Valiulis et al. | D8/380 |
| 6,622,979 | B2 * | 9/2003 | Valiulis | 248/220.42 |
| 6,698,124 | B2 | 3/2004 | Kump et al. | |
| 6,722,619 | B2 | 4/2004 | Valiulis et al. | |
| 6,823,999 | B2 * | 11/2004 | Heneveld, Sr. | 211/87.01 |
| 2002/0166275 | A1 | 11/2002 | Broadwell et al. | |
| 2003/0057336 | A1 * | 3/2003 | Hochman | 248/220.21 |
| 2003/0071181 | A1 | 4/2003 | Valiulis et al. | |
| 2003/0164432 | A1 | 9/2003 | Shea | |

* cited by examiner

*Primary Examiner*—J. Allen Shriver
*Assistant Examiner*—Tan Le
(74) *Attorney, Agent, or Firm*—Ingrassia Fisher & Lorenz, P.C.

(57) ABSTRACT

A bracket assembly for use with a vertical display having regularly spaced apertures includes a generally planar surface, at least one finger extending rearward from the generally planar surface and adapted to mount the generally planar surface to the display via an aperture, at least one fastener, at least one guide extending forward from the generally planar surface, and a stop. The at least one fastener is configured to extend through the generally planar surface and adapted to engage the display via an aperture to selectively secure the generally planar surface to the display. The stop extends forward from the generally planar surface, wherein the stop and the at least one guide together are adapted to vertically receive and position a standard generally in parallel with the generally planar surface.

19 Claims, 12 Drawing Sheets

BRACKET FOR RETAIL STORE DISPLAY SYSTEMS

BACKGROUND OF THE INVENTION

Businesses typically use a variety of display systems to present products to consumers. These display systems often employ a vertical support wall system, such as a pegboard, to which shelves, hooks, and other devices are secured to display products. In order to draw attention to the displayed items and/or assist the consumer in locating items, signs and other identifying indicia are often mounted to the pegboard.

The shelves, hooks, signage and other devices are typically secured to the pegboard with some type of mounting bracket. The use of mounting brackets to secure devices is known in the industry. However, these brackets are often complicated to manufacture, including flaps, notches, multiple angles, and multiple bends, while others are cumbersome to install. Consequently, businesses are continually looking for improved mounting devices.

SUMMARY OF THE INVENTION

One embodiment of the present invention relates to a bracket assembly for use with a vertical display having regularly spaced apertures. The bracket assembly includes a generally planar surface, at least one finger extending rearward from the generally planar surface and adapted to mount the generally planar surface to the display via an aperture, at least one fastener, at least one guide extending forward from the generally planar surface, and a stop. The at least one fastener is configured to extend through the generally planar surface and adapted to engage the display via an aperture to selectively secure the generally planar surface to the display. The stop extends forward from the generally planar surface, wherein the stop and the at least one guide together are adapted to vertically receive and position a standard generally in parallel with the generally planar surface.

BRIEF DESCRIPTION OF THE DRAWINGS

Embodiments of the invention will be described with respect to the figures, in which like reference numerals denote like elements, and in which.

DETAILED DESCRIPTION

Figure 1:
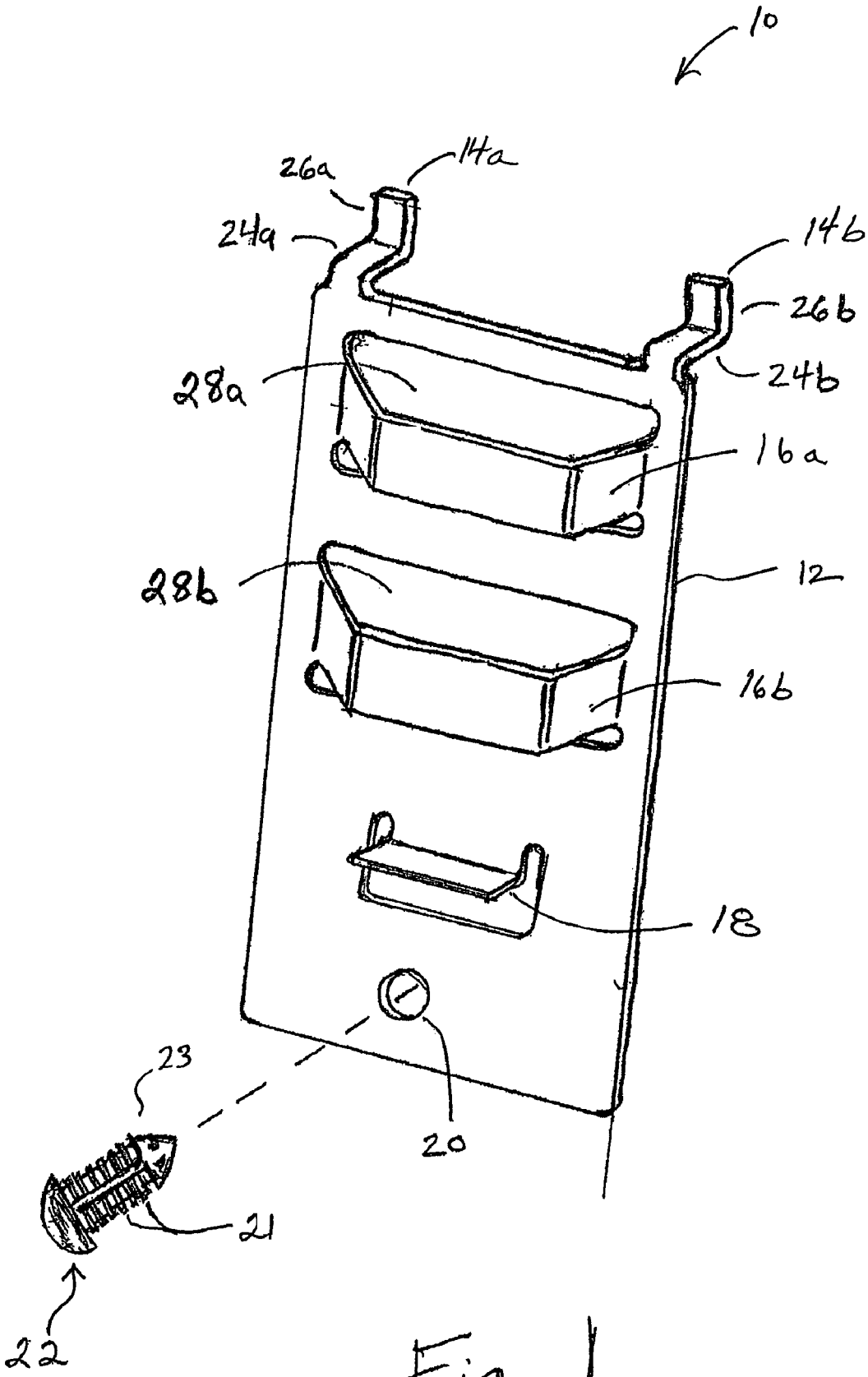
FIG. 1 is a perspective view illustrating one embodiment of a bracket assembly according to the present invention.

FIGS. 1-6 illustrate one embodiment of a bracket assembly 10 for use with a vertical display, such as pegboard, having regularly spaced apertures. FIG. 1 is a perspective view of bracket assembly 10. Bracket assembly 10 includes a generally planar plate 12, a pair of fingers 14*a*, 14*b*, a pair of guides 16*a*, 16*b*, a stop 18, an opening 20, and a fastener 22. Fingers 14*a*, 14*b* are horizontally spaced along an upper edge of plate 12, with each finger 14*a*, 14*b* including a first segment 24*a*, 24*b* extending rearward from plate 12 and a second segment 26*a*, 26*b* extending upward from first segment 24*a*, 24*b*. Fingers 14*a*, 14*b* are spaced and adapted to mount plate 12 to the vertical display via the regularly spaced apertures in the vertical display. In one embodiment, as illustrated, hole 20 is positioned below stop 18. In one embodiment, plate 12, fingers 14*a*, 14*b*, guides 16*a*, 16*b*, stop 18, and opening 20 are formed from a single, contiguous piece of metal which is stamped and bent to achieve a desired shape.

Fastener 22 is adapted to slideably insert through opening 20 and an appropriately aligned aperture in the display to engage the display and to selectively secure plate 12 to the vertical display. In one embodiment, as illustrated, fastener 22 comprises a plastic plug having a plurality of generally parallel pliable flanges 21 spaced to form a compressible shaft 23. In an uncompressed state, flanges 21 are generally perpendicular to a longitudinal direction of shaft 23 such that the diameter of shaft 23 is incrementally larger than a diameter of circular opening 20 and the appropriately aligned aperture. As fastener 22 is inserted through opening 20 and the appropriately aligned aperture, pliable flanges 21 deflect from their generally perpendicular position to enable shaft 23 to be pushed through opening 20 and the aligned aperture. After being inserted, pliable flanges 21 on a portion of shaft 23 that extends through the aligned aperture return to their generally perpendicular position such that the portion of the shaft extending through the aligned aperture has a diameter larger than the diameter of the aligned aperture, thereby selectively securing plate 12 to the display. Fastener 22 is illustrated in an installed position in FIG. 7B to be described.

Guides 16*a*, 16*b* extend generally forward from plate 12 and, along with plate 12, form open-ended slots 28*a*, 28*b*. In one embodiment, as illustrated and as will be described in greater detail below, guides 16*a*, 16*b* are configured to form generally trapezoidal-shaped slots 28*a*, 28*b*. Slots 28*a*, 28*b* and stop 18 are generally vertically aligned and together are adapted to receive and generally vertically position a standard generally in parallel with and in contact with plate 12.

Figure 2:
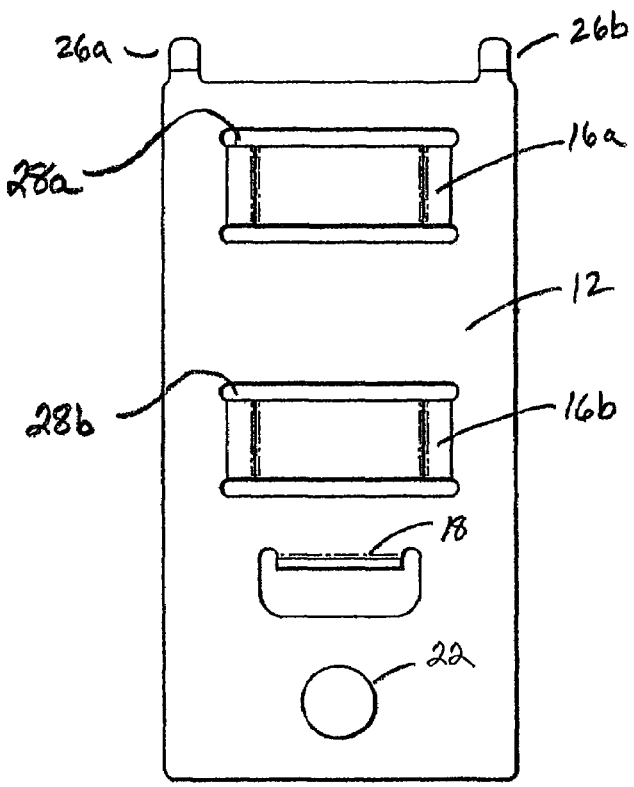
FIG. 2 is a front view of the bracket assembly illustrated by FIG. 1.
Figure 3:
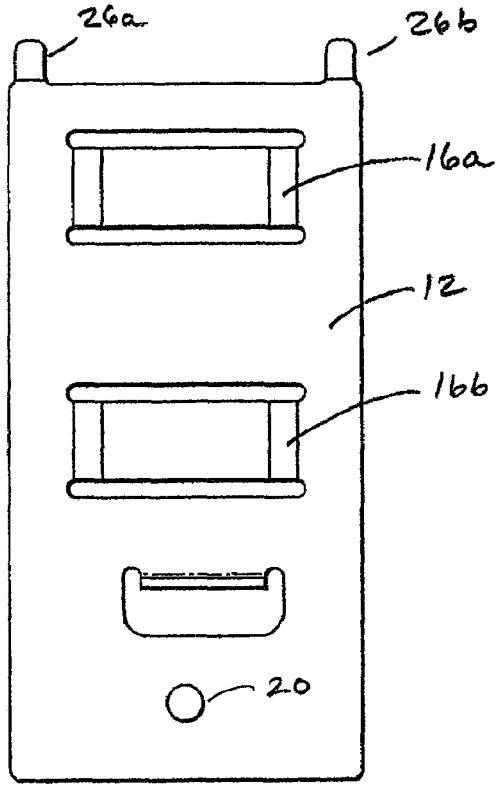
FIG. 3 is a rear view of the bracket assembly illustrated by FIG. 1.
Figure 4:
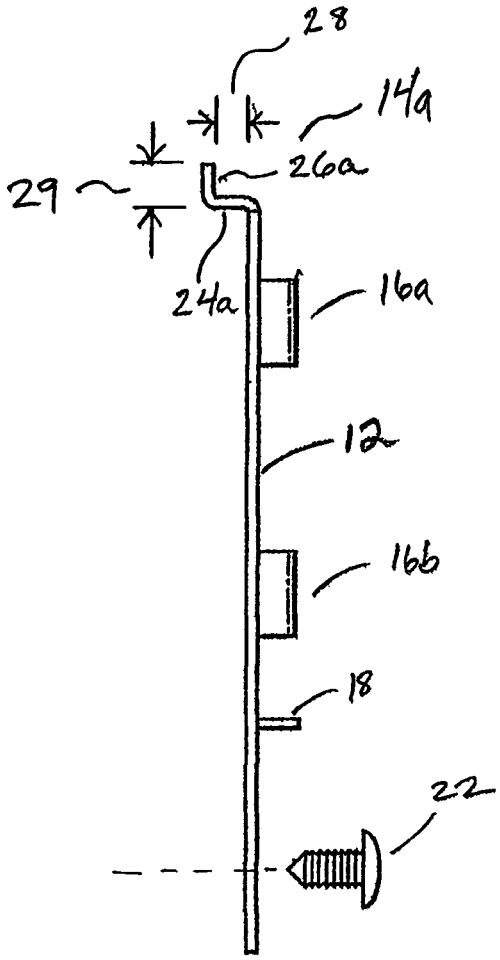
FIG. 4 is a left side view of the bracket assembly illustrated by FIG. 1.
Figure 5:
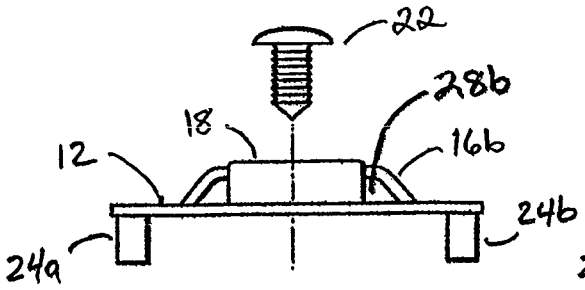
FIG. 5 is a top view of the bracket assembly illustrated by FIG. 1.
Figure 6:
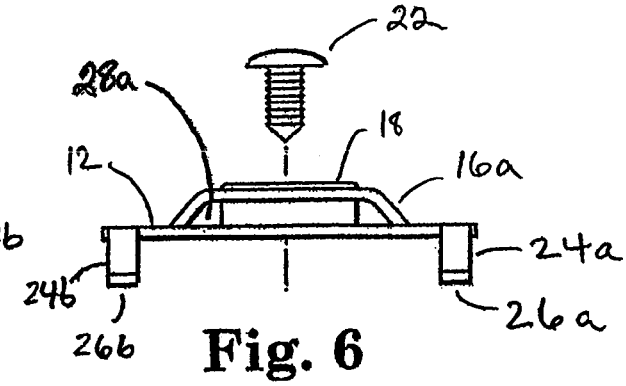
FIG. 6 is a bottom view of the bracket assembly illustrated by FIG. 1.

FIGS. 2-6 illustrate various views of bracket assembly 10 as illustrated by FIG. 1. FIGS. 2 and 3 respectively illustrate front and rear views of bracket assembly 10. FIG. 4 illustrates a left side view of bracket assembly 10. As described above with respect to FIG. 1, finger 14*a* comprises first segment 24*a* extending rearward from plate 12 and second segment 26*a* extending upwardly from first segment 24*a*and finger 14*b* comprises first segment 24*b* extending rearward from plate 12 and second segment 26*b* extending upwardly from first segment 24*b*. First segments 24*a*, 24*b* have a depth 28 incrementally greater than a depth of the vertical display apertures, and second segments 26*a*, 26*b* have a height 29 incrementally greater than a vertical height of the vertical display apertures. Guides 16*a*, 16*b* and stop 18 extend forward from plate 12. In one embodiment, as illustrated, stop 18 is bent outwardly so as to be substantially perpendicular with plate 12. FIGS. 5 and 6 respectively illustrate bottom and top views of bracket assembly 10. As illustrated by FIGS. 4-6, in one embodiment, stop 18 extends outwardly from plate 12 to a distance greater than a distance to which guides 16*a*, 16*b* extend from plate 12. Together, FIGS. 1-6 illustrate the ornamental appearance of a bracket and a bracket assembly according to embodiments of the invention as described herein.

Figure 7A:
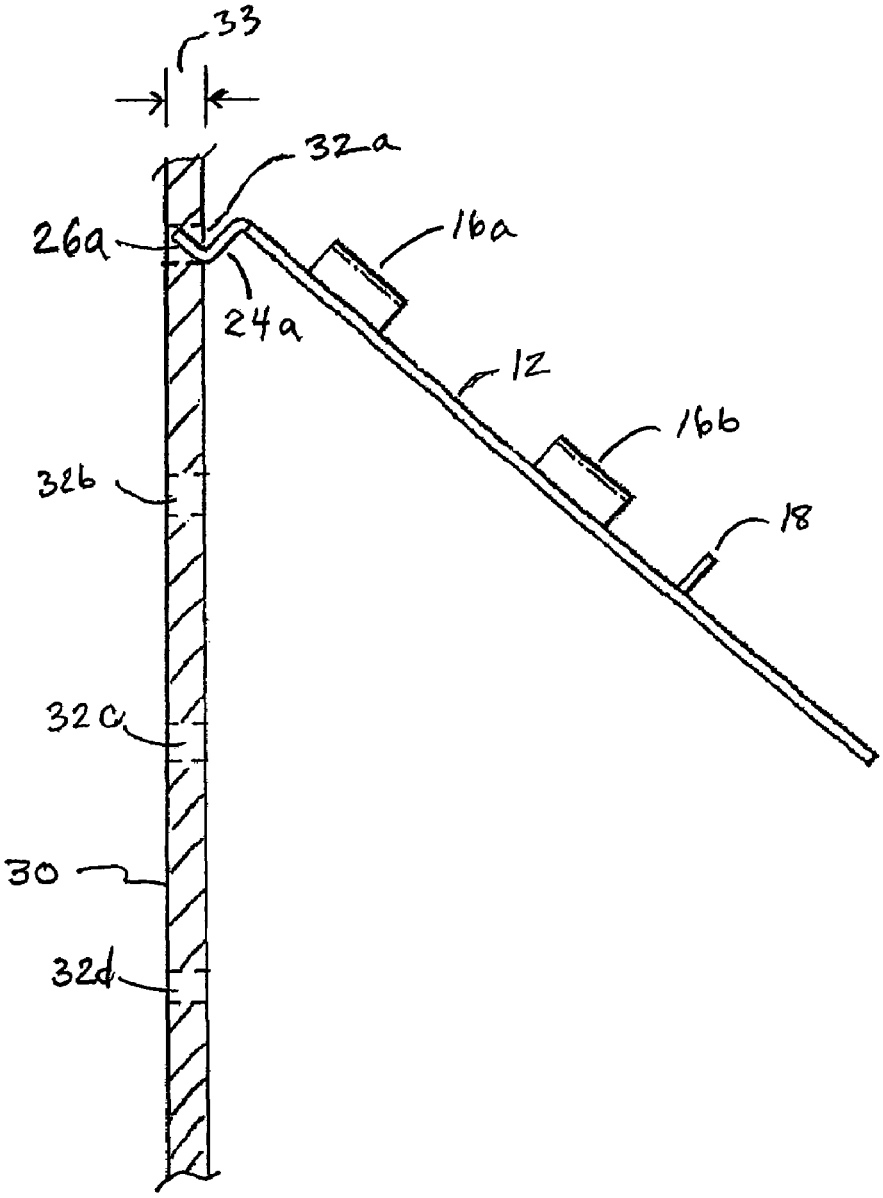
FIG. 7A is a side view illustrating the bracket assembly of FIG. 1 being installed in a vertical pegboard.
Figure 7B:
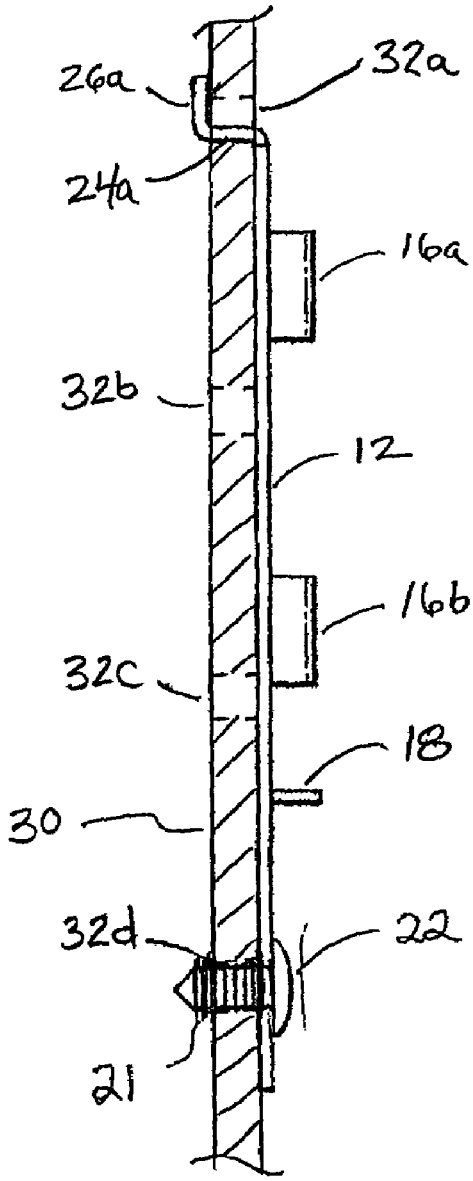
FIG. 7B is a left side view illustrating the bracket assembly of FIG. 1 installed in a vertical pegboard.

FIG. 7A illustrates bracket assembly 10 being installed in a vertical display, such as pegboard 30, for example, having regularly spaced apertures 32*a*, 32*b*,32*c*, 32*d* (collectively referred to as "apertures 32").Initially, the bottom of plate 12 is held outwardly from pegboard 30 so that second segments 26*a*, 26*b*, illustrated as segment 26*a*, can be inserted into the pegboard apertures 32, such as aperture 32*a*. In the example illustration, height 29 (FIG. 4) of second segments 26*a*, 26*b* is incrementally greater than a diameter of apertures 32, and depth 28 (FIG. 4) of first segments 24*a*, 24*b* is incrementally greater than a depth 33 of pegboard 30. As illustrated by FIG. 7B, after second segments 26*a*, 26*b* are inserted through apertures 32, plate 12 is rotated downward until the rear of plate 12 is substantially flush with pegboard 30, at which point an upper portion of plate 12 is mounted to pegboard 30 through the contact of first and second segments 24*a*, 24*b* and 26*a*, 26*b* with pegboard 30.

Fastener 22 is then inserted through opening 20 and an appropriately aligned aperture, such as aperture 32*d*, to engage pegboard 30 and secure a lower portion of plate 12 to pegboard 30. In one embodiment, fastener 22 is pre-inserted through opening 20 and is inserted through aperture 32*d* as plate 12 is rotated downward and the rear of plate 12 is made substantially flush with pegboard 30. As illustrated, after being inserted, pliable flanges 21 on the portion of shaft 23 that extends through aligned aperture 32*d* return to their generally perpendicular position such that the portion of the shaft 23 extending through the aligned aperture 32*d* has a diameter larger than the diameter of aligned aperture 32*d*, thereby selectively securing the plate 12 to pegboard 30.

Figure 7C:
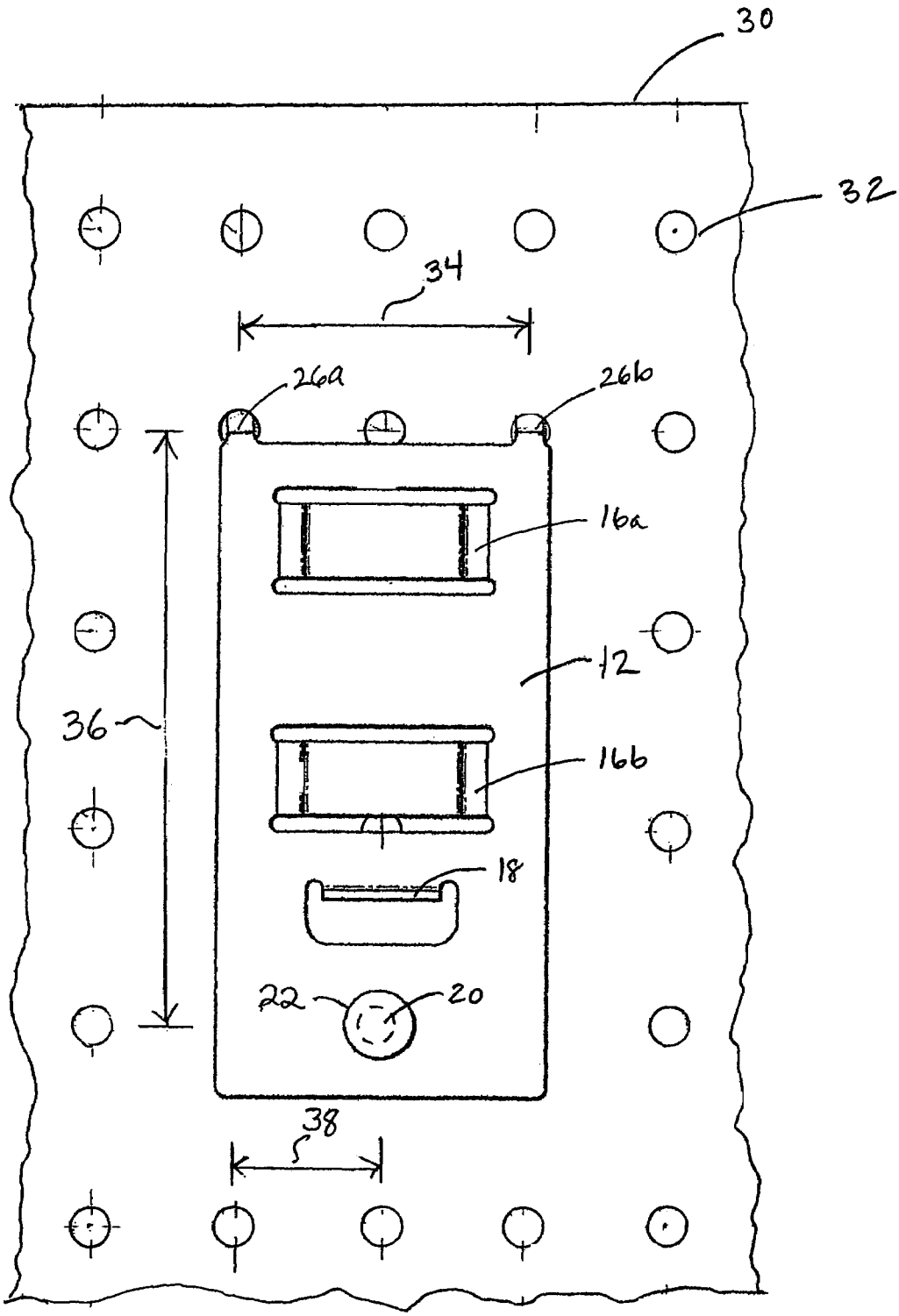
FIG. 7C is a front view illustrating the bracket assembly of FIG. 1 installed in a pegboard.

FIG. 7C is a front view illustrating bracket assembly 10 of FIG. 7B mounted and secured to pegboard 30. Fingers 14*a*, 14*b* are horizontally spaced apart by a distance 34 along an upper edge of plate 12, and opening 20 is vertically spaced below fingers 14*a*, 14*b* by a distance 36. In one embodiment, as illustrated, fingers 14*a* and 14*b* are spaced to straddle at least one column of apertures 32, and opening 20 is vertically offset to straddle at least one row of apertures 32 and horizontally offset a distance 38 so as to align with at least one column of apertures 32 straddled by fingers 14*a* and 14*b*. Apertures 32 of pegboard 30 are generally spaced at ½-inch or 1-inch intervals and sized to be compatible with standardized peg hooks available to the display industry. In one embodiment, fingers 14*a*, 14*b* are spaced a distance 34 substantially equal to 2-inches, and opening 20 is vertically offset a distance 36 of 4-inches and horizontally offset a distance of 1-inch from fingers 14*a* and 14*b*.

Figure 8A:
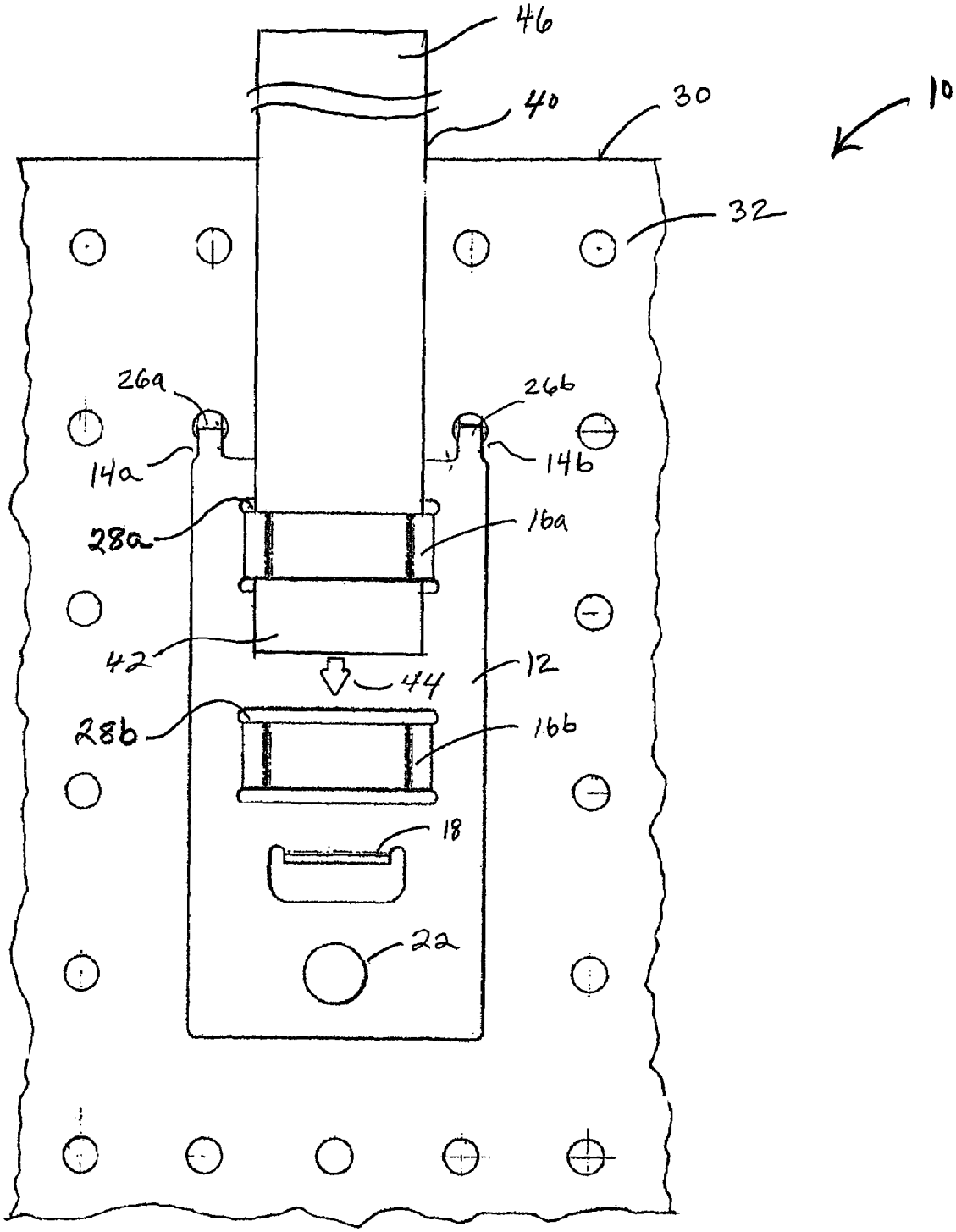
FIG. 8A is a front view illustrating a standard being installed in the bracket assembly depicted by FIG. 7C.

In one embodiment, as illustrated by FIG. 8A, bracket assembly 10 further includes a standard 40 having a first end 42 which is slideably inserted in a direction 44 into a channel formed by slots 24*a* and 24*b* (see FIG. 1) of guides 16*a* and 16*b* and having a bottom formed by stop 18. In one embodiment, as illustrated, standard 40 comprises a flat bar having a second end 46 which is adapted to secure signage or other display means. As indicated by FIG. 8B, standard 40 is slid downward through slots 24*a* and 24*b* until first end 42 abuts and rests on stop 18.

Figure 8B:
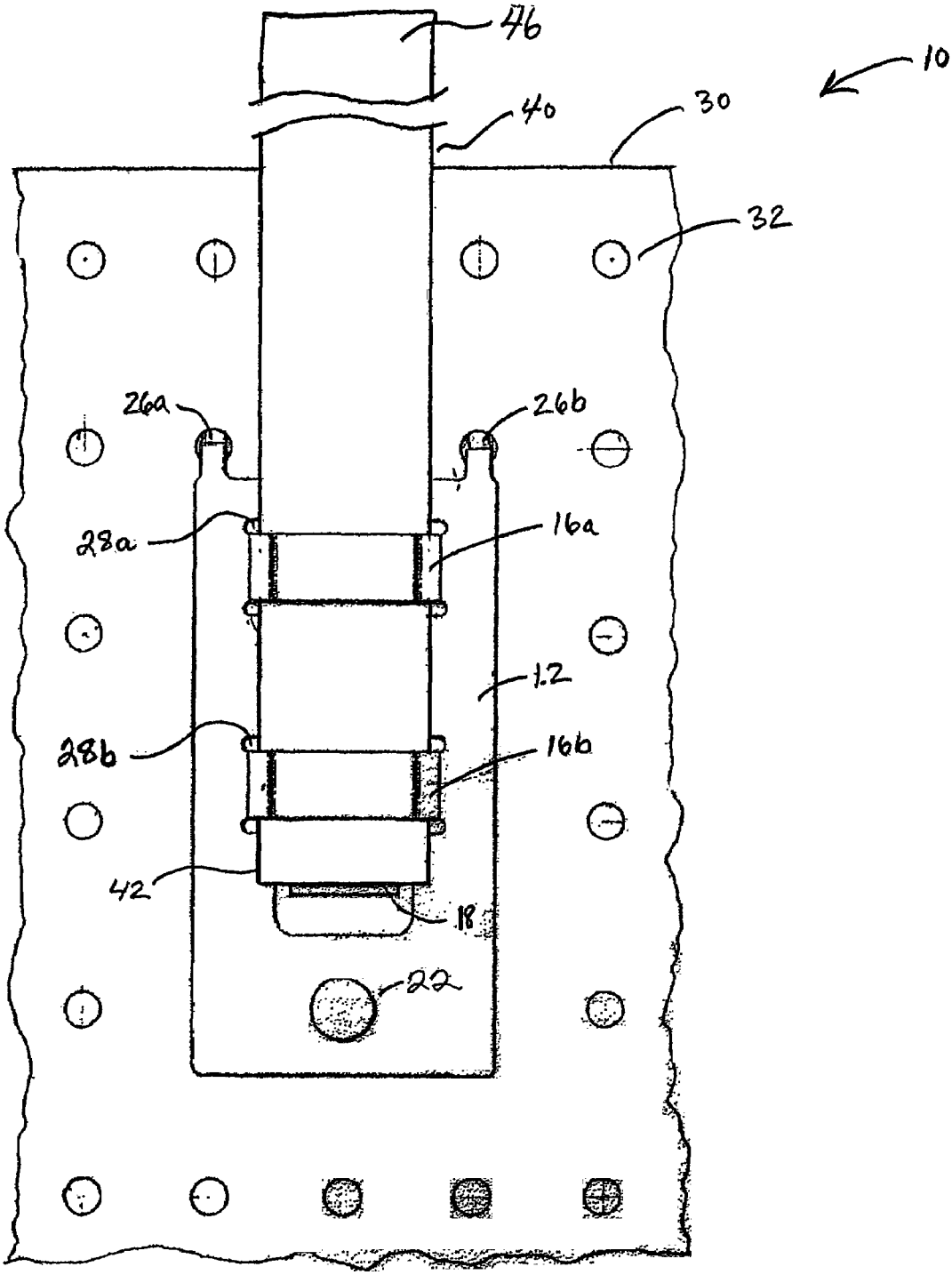
FIG. 8B is a front view illustrating a standard installed in the bracket assembly depicted by FIG. 7C.
Figure 8C:
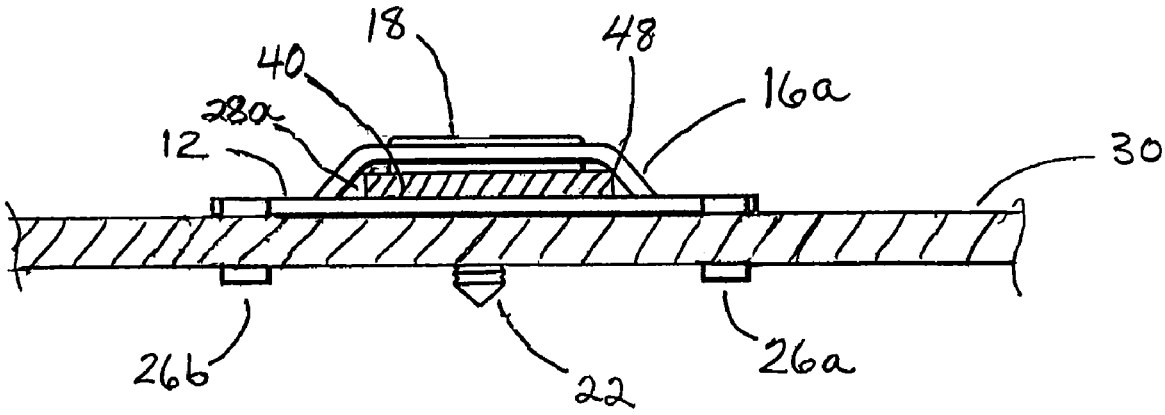
FIG. 8C is a top view illustrating a standard installed in the bracket assembly depicted by FIG. 8B.

FIG. 8C is a top view of standard 40 installed bracket assembly 10 as depicted by FIG. 8B. In one embodiment, as illustrated by FIG. 8C, and as briefly described above by FIG. 1, guides 16*a* and 16*b* form generally trapezoidal slots 24*a*, 24*b*. The angled sides of trapezoidal openings 24*a*, 24*b* are adapted to engage the corners 48 of bar-like standard 40 so as to force standard 40 to be substantially horizontally centered within openings 24*a*, 24*b*. Additionally, by engaging corners 48, guides 16*a*, 16*b* substantially eliminate or reduce lateral movement of standard 40.

Figure 9:
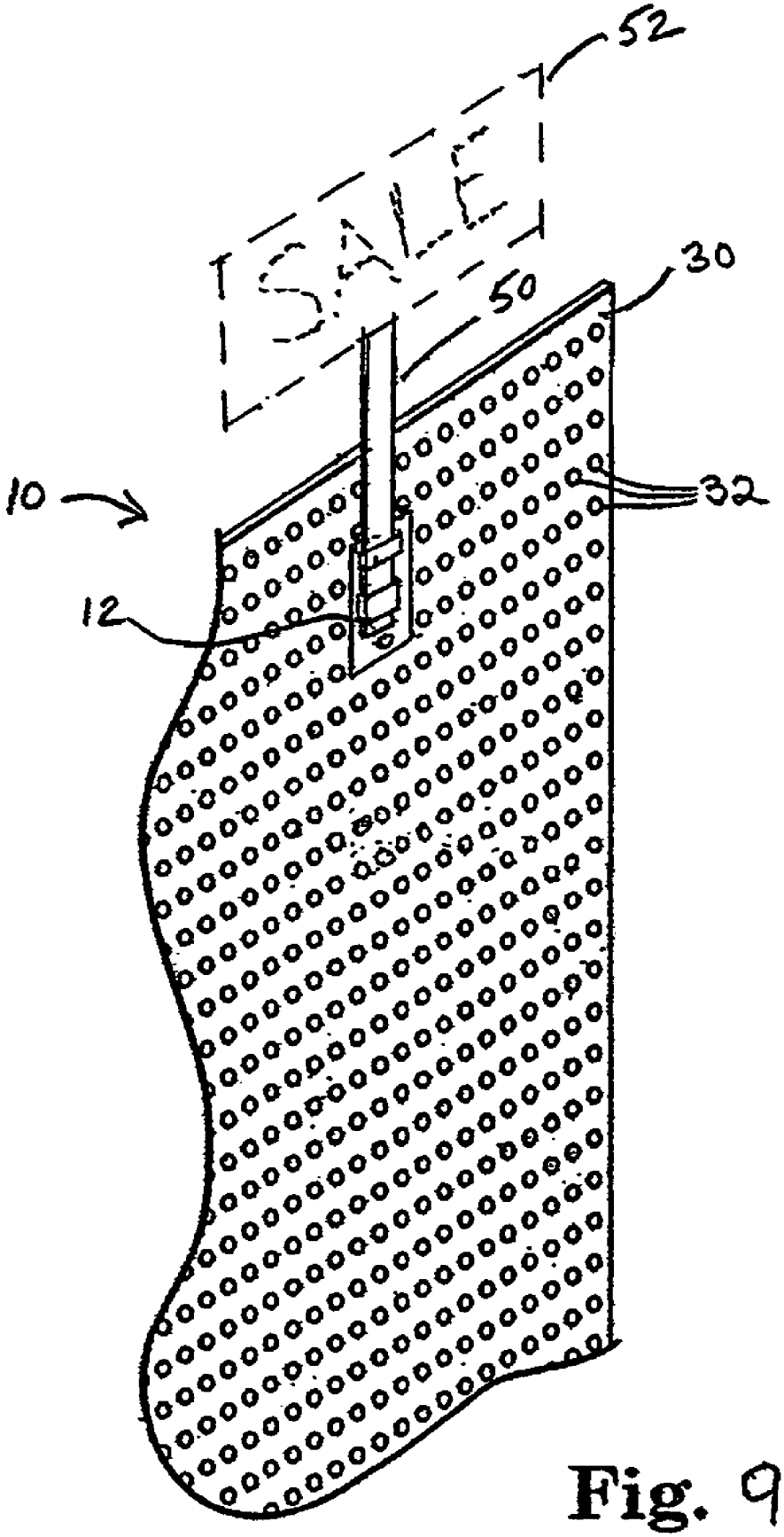
FIG. 9 is a perspective view illustrating one embodiment of a bracket assembly according to the present invention.
Figure 10:
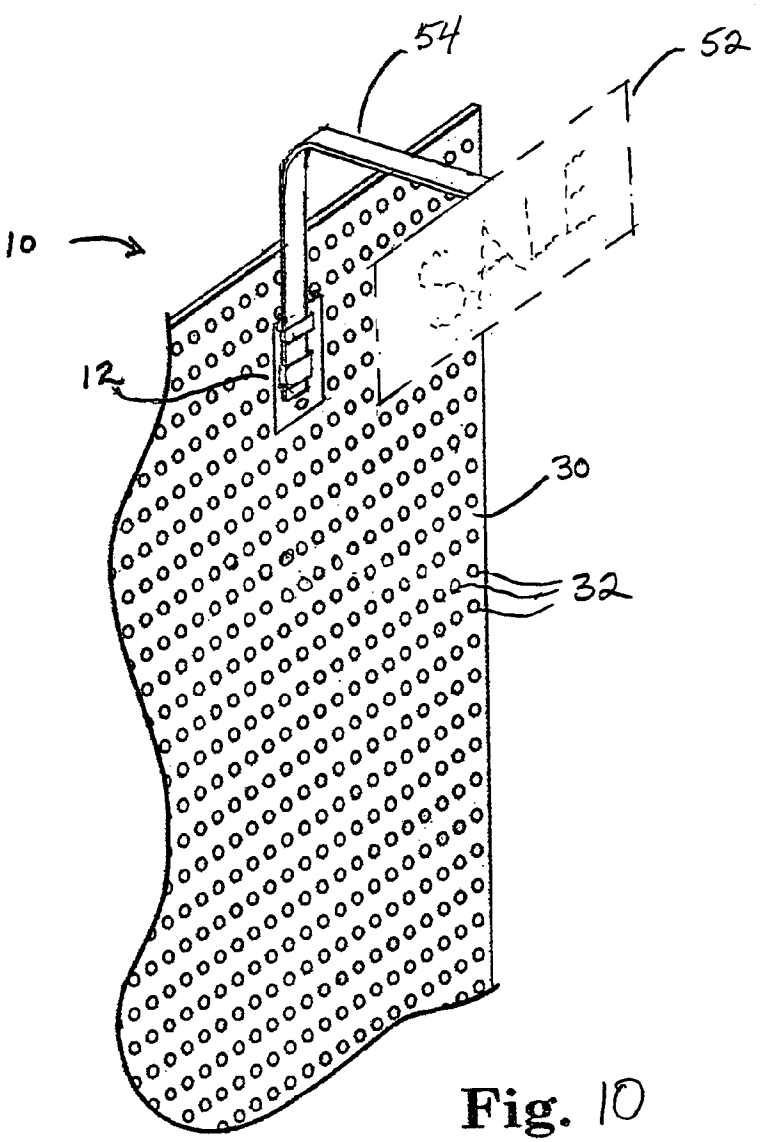
FIG. 10 is a perspective view illustrating one embodiment of a bracket assembly according to the present invention.
Figure 11:
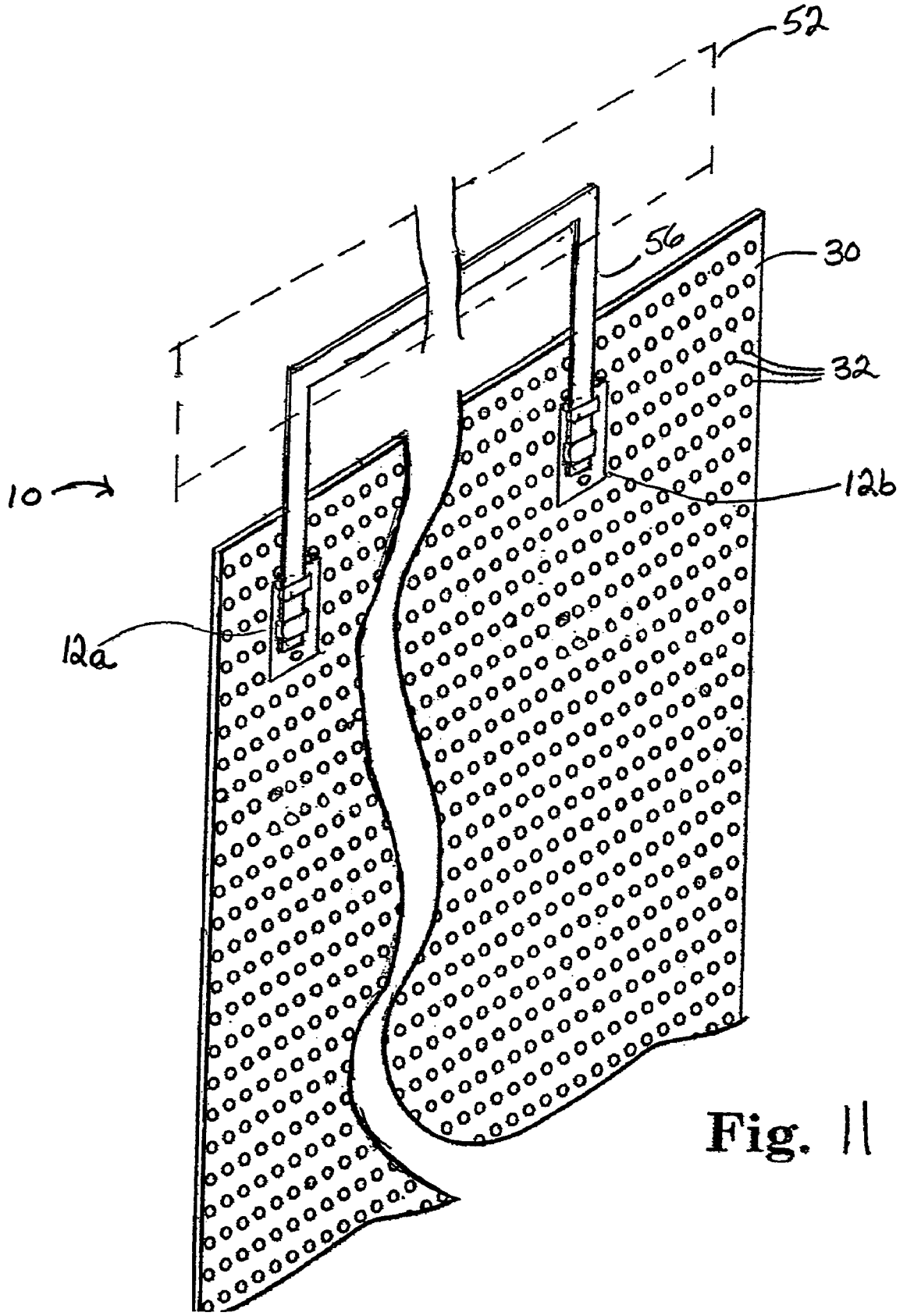
FIG. 11 is a perspective view illustrating one embodiment of a bracket assembly according to the present invention.

FIG. 9 is a perspective view illustrating one embodiment of bracket assembly 10, including bar-like standard 50 which vertically extends above pegboard display 30 and is adapted to secure a display device, such as sign 52. FIG. 10 is perspective view illustrating another embodiment of bracket assembly 10, including a bar-like standard 54 that extends vertically above and arcuately forward from pegboard display 30 and is adapted to secure a display device, such as sign 52. FIG. 11 is a perspective view illustrating a further embodiment of bracket assembly 10 according to the present invention, wherein bracket assembly 10 includes a pair of plates 12*a* and 12*b*, each mounted to pegboard display 30 and including fingers 14*a* and 14*b*, guides 16*a* and 16*b*, stop 18, opening 20, and fastener 22 (FIG.1). Each plate 12*a* and 12*b* is configured to receive and support opposite ends of a U-shaped standard 56 that extends vertically from and horizontally above pegboard display 30 and is adapted to secure a sign 52, or other display device.

Although the invention has been described with respect to particular embodiments, such embodiments are for illustrative purposes only and should not be considered to limit the invention. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. Various alternatives and changes will be apparent to those of ordinary skill in the art.

What is claimed is:

1. A display system comprising:

a display having a plurality of regularly spaced apertures;

a standard; and a bracket assembly comprising:

a generally planar surface;

at least one finger extending rearward from the generally planar surface and mounting the generally planar surface to the display via a first aperture selected from the plurality of regularly spaced apertures, the at least one finger having a bend such that the at least one finger includes a first segment extending rearward from the generally planar surface and having a depth substantially greater than the first aperture and a second segment extending upward from the first segment having a height substantially greater than a diameter of the first aperture;

at least one guide extending forward from the generally planar surface;

at least one fastener extending through the generally planar surface and engaging the display via a second aperture selected from the plurality of regularly spaced apertures to selectively secure the generally planar surface to the display; and a stop extending forward from the generally planar surface spaced from the at least one guide, wherein the stop and the at least one guide together vertically receive and position the standard generally in parallel with the generally planar surface such that the bracket assembly substantially prevents rotation of the standard relative to the bracket assembly.

2. The display system of claim 1, wherein the generally planar surface, the at least one finger, the at least one guide, and the stop are formed from a single contiguous piece of material.

3. The display system of claim 2, wherein the material comprises a metal.

4. The display system of claim 1, wherein the bracket assembly further includes an opening through the generally planar surface positioned relative to the at least one finger so as to align with the second aperture, and wherein the at least one fastener is slideably inserted through the opening and the second aperture to engage the display and to selectively secure the generally planar surface to the display.

5. The display system of claim 4, wherein the opening is positioned below the at least one finger and the stop.

6. The display system of claim 4, wherein the fastener includes a compressible shaft that compresses to enable the shaft to be inserted through the opening and the second aperture and expands along a segment of the shaft extending through the second aperture to selectively secure the generally planar surface to the display.

7. The display system of claim 4, wherein the fastener includes a plurality of pliable flanges along a shaft of the fastener that deflect from a position generally perpendicular to the shaft to enable the shaft to be inserted through the opening and second aperture and return to the generally perpendicular position along a segment of the shaft extending through the second aperture to secure the generally planar surface to the display.

8. The display system of claim 1, wherein the fastener comprises a plastic material.

9. The display system of claim 1, wherein the at least one finger comprises:

a first finger including the first segment extending rearward from the generally planar surface and the second segment extending upward from the first segment; and a second finger extending rearward from the generally planar surface and mounting the generally planar surface to the display via the second aperture, wherein the generally planar surface defines an upper edge and the second finger is horizontally spaced from the first finger along the upper edge of the generally planar surface.

10. A display system comprising:

a display having a regular array of apertures;

a bar-like standard; and a support base comprising;

a plate having a front surface and a back surface;

at least one mounting member extending from the back surface and configured to selectively engage the display within at least one of the apertures;

at least one closed retainer extending from the front surface to support a portion of the bar-like standard generally in parallel with and in contact with the front surface of the plate, wherein the closed retainer and the front surface together form an open-ended slot supporting the bar-like standard generally in parallel with and in contact with the front surface of the plate, and the open-ended slot is generally trapezoidal in shape to generally prevent rotation of the bar-like standard within the open-ended slot; and a rest extending from the front surface such that the bar-like standard extends through a top of the at least one closed retainer and abuts the rest;

wherein the plate has a through hole positioned below the at least one closed retainer and aligned with another one of the apertures for receiving a fastener to secure the plate to the display.

11. The display system of claim 10, wherein the closed retainer is adapted to generally horizontally center the bar-like standard within the open-ended slot.

12. The display system of claim 10, wherein the rest is positioned below the at least one closed retainer, and wherein the rest and the open-ended slot together form a channel adapted to vertically receive the bar-like standard.

13. A display system comprising:

a vertical display having regularly spaced apertures;

a standard;

at least one fastener; and a bracket comprising:

a plate having a front surface and a rear surface;

at least one prong extending from the rear surface and mounting the bracket to the display via a first aperture of the regularly spaced apertures;

at least one guide extending from and forming a slot with the front surface, the at least one guide including a linear portion substantially parallel with the front surface of the plate; and a rest extending from the front surface and positioned below the guide, the slot and the rest together forming a channel substantially in parallel with and having at least one side formed by the front surface and at least one other side formed by the linear portion of the at least one guide;

wherein the plate includes at least one through hole below the rest for receiving the at least one fastener extending through the plate via the at least one hole to engage the display via a second aperture of the regularly spaced apertures to selectively secure the plate to the display; and further wherein the standard has a proximal end vertically and slideably inserted through a top of the channel such that the proximal end of the standard abuts the rest.

14. The display system of claim 13, wherein the standard comprises a generally flat bar.

15. The display system of claim 14 wherein the bracket maintains the standard such that an intermediate section of the standard extends generally upward from the proximal end of the standard such that a distal end of the standard is positioned vertically above the intermediate section and the proximal end.

16. The display system of claim 13 wherein the bracket maintains the standard such that an intermediate section of the standard extends generally upward from the proximal end of the standard and forward from the plate such that a distal end of the standard is positioned forward from the display and vertically above the intermediate section and the proximal end of the standard.

17. The display system of claim 16, wherein the slot and the rest are adapted to maintain the intermediate section of the standard, the intermediate section defining a generally arcuate shape.

18. A bracket assembly for use with a display having regularly spaced apertures, the bracket assembly comprising:

a plate having a generally planar surface and an upper edge and defining an opening adapted to align with a first aperture of the regularly spaced apertures;

a first finger extending rearward from the generally planar surface and adapted to mount the plate to the display via a second aperture of the regularly spaced apertures, the first finger bending such that the first finger includes a first segment extending rearward from the generally planar surface and a second segment extending upward from the first segment of the first finger;

a second finger extending rearward from the generally planar surface and adapted to mount the plate to the display via a third aperture of the regularly spaced apertures, the second finger bending such that the second finger includes a first segment extending rearward from the generally planar surface and a second segment extending upward from the first segment of the second finger, the second finger being horizontally spaced from the first finger along the upper edge of the plate;

at least one guide extending forward from the generally planar surface to form a trapezoidal slot between the at least one guide and the generally planar surface;

at least one fastener configured to extend through the plate and adapted to engage the display via an aperture to selectively secure the plate to the display, wherein the at least one fastener includes a plurality of pliable flanges along a shaft of the at least one fastener that are configured to deflect from a position generally perpendicular to the shaft to enable the shaft to be inserted through the opening in the plate and the first aperture and to return to the generally perpendicular position along a segment of the shaft extending through the first aperture to selectively secure the generally planar surface to the display; and a stop extending forward from the generally planar surface, wherein the stop and the at least one guide together are adapted to vertically receive and position a standard within the slot and generally in parallel with the generally planar surface, wherein the at least one guide and the plate are configured to collectively interact with the standard to decrease rotation of the standard relative to the plate;

wherein the plate, the first and second fingers, the at least one guide, and the stop are formed from a single contiguous piece of material.

19. The bracket assembly of claim 18, wherein the opening is positioned below the first and the second fingers and the stop.

* * * * *